US006138849A

United States Patent [19]

Roemer et al.

[11] Patent Number: 6,138,849

[45] Date of Patent: Oct. 31, 2000

[54] PLASTIC WELD POURER COMPONENT HAVING SAFETY PROPERTIES

[75] Inventors: Frank Roemer, Finnentrop; Johannes Hins, Sundern, both of Germany

[73] Assignee: Georg Menshen GmbH & Co. KG, Finnentrop, Germany

[21] Appl. No.: 09/152,687

[22] Filed: Sep. 14, 1998

Related U.S. Application Data

[63] Continuation-in-part of application No. PCT/EP98/03631, Jun. 6, 1998.

[51] Int. Cl.[7] ..... B65D 1/02

[52] U.S. Cl. ..... 215/48; 215/253; 220/266

[58] Field of Search ..... 215/47, 48, 306, 215/305, 253; 220/266, 375; 383/80, 96, 906

[56] References Cited

U.S. PATENT DOCUMENTS

| | | | |
|---|---|---|---|
| 906,157 | 12/1908 | Porter | 215/48 X |
| 1,778,625 | 10/1930 | Davis | 220/375 X |
| 2,066,390 | 1/1937 | Cahoon et al. | 215/253 |
| 4,512,475 | 4/1985 | Federighi | 215/48 X |
| 4,583,652 | 4/1986 | Goldberg | 215/306 X |
| 5,188,250 | 2/1993 | Kovacic et al. | 215/48 |
| 5,823,383 | 10/1998 | Hins | 383/906 X |

FOREIGN PATENT DOCUMENTS

| | | | |
|---|---|---|---|
| 493723 | 7/1992 | European Pat. Off. | 383/80 |
| 2644426 | 9/1990 | France | 215/48 |
| 81857 | 2/1916 | Germany | 215/306 |
| 2335982 | 1/1975 | Germany | 215/306 |
| 566904 | 9/1975 | Switzerland | 215/48 |
| 1054335 | 1/1967 | United Kingdom | 215/48 |
| 2006712 | 5/1979 | United Kingdom | 215/48 |

*Primary Examiner*—Stephen K. Cronin
*Assistant Examiner*—Robin A. Hylton
*Attorney, Agent, or Firm*—Birch, Stewart, Kolasch & Birch, LLP

[57] ABSTRACT

A plastics weld pourer component having child-proof properties for attachment by welding to a container component of film-like plastics material, includes a tubular body portion defining a through passage having axially spaced ends. A plurality of welding ribs is formed integrally on the outer periphery of the body portion near one axial end of the through passage. Furthermore, a cap member is integrally formed on the body portion near the other axial end, said cap member sealing the through passage at one end. The cap member is attached to the body portion through a weakened portion which is adapted to break when a rotational force is exerted by hand on the cap member. The dimensions of the cap member relative to those of the body portion are made such that the cap member can be placed on the body portion for repeatedly sealing the through passage after it has been separated from the body portion. Furthermore, the cap member is also permanently attached in one-piece manner to the body portion through a meandering strap. A radially spaced ring element integrally formed with the cap member provides a flow passage between the cap member and the ring element, said flow passage acting as an emergency breathing passage should the cap member be accidentally swallowed.

6 Claims, 1 Drawing Sheet

PLASTIC WELD POURER COMPONENT HAVING SAFETY PROPERTIES

This application is a continuation-in-part application of U.S. application PCT/EP98/03631, filed Jun. 6, 1998 listing the U.S. as a National Phase country.

FIELD OF THE INVENTION

The invention relates to a plastics weld pourer component for attachment by welding to a container component of film-like plastics material, especially to one having child-safety properties.

BACKGROUND OF THE INVENTION

Weld pourer components of this type are needed for refillable bags for liquid or fluid or paste-like products as well as all sorts of cleaning materials. The welded connection is generally produced by means of an ultrasonic welding process. With known weld pourer components, a screw cap may be provided for sealing a through passage so that the latter can be repeatedly hermetically sealed after use. Hermetic sealing of the through passage by means of an integrally formed, pierceable foil is also known. The pierceable foil additionally acts as a tamper-proof seal. A combination of a pierceable foil and a screw cap has also been proposed.

An object of the invention is to provide a plastics weld pourer component of the aforesaid type having child-safety properties. A further object of the invention is to provide a child-safety, plastics weld pourer component which is additionally provided with sealing and tamper-proof functions similar to those of a pierceable foil. Another object of the invention is to provide a child-safety plastics weld pourer component which can be manufactured with all of the aforementioned functions as a single part using an injection moulding process. A further object of the invention is to provide a child-safety, plastics weld pourer component in which there are no loose portions thereof either before, during or after it is used for the first time.

SUMMARY OF THE INVENTION

A plastics weld pourer component in accordance with the invention includes a tubular body portion defining a through passage having axially spaced ends, said through passage is open at one of the axial ends, at least one welding rib integrally formed on the body portion on the outer periphery thereof near the open end of the through passage and outwardly projecting therefrom, a cap member integrally formed on the body portion near the other end of the through passage and having a base wall and a peripheral wall projecting therefrom, said cap member hermetically seals the adjacent end of the through passage in that the cap member is attached to the body portion through a circumferentially extending weakened portion adapted to break when a rotational force is exerted by hand on the cap member, and the dimensions of the cap member are adapted to those of the body portion such that the cap member can be placed onto the body portion for repeatedly sealing the through passage after it has been separated from the body portion, and furthermore, wherein a ring element circumferentially surrounds the cap member in spaced relationship thereto and is attached thereto by means of webs so that an essentially axial ventilation passage is formed between the ring element and the outer periphery of the cap member. In accordance with a preferred embodiment of the invention, the cap member is further connected to the body portion by means of a strap extending therebetween. The strap provides a permanent connection between the cap member and the tubular body portion so that the two parts remain connected to one another even after the other connection in the form of the weakened portion between the cap member and the body portion has been cut. In each case, the ring element integrally formed with the outher periphery of the cap member and spaced thereto ensures that an axial air passage is defined between it and the cap member, said air passage providing a breathing passage along the cap member should the latter be swallowed and then become lodged in the windpipe of a child for example, either because the cap member is intended to be used as a part separated from the plastics weld pourer component or has been broken off therefrom for example by cutting the strap. This breathing passage allows breathing to take place until medical help can be obtained.

BRIEF DESCRIPTION OF THE DRAWING

The invention will be explained in detail hereinafter with reference to an embodiment and the drawing, in which.

DETAILED DESCRIPTION OF THE INVENTION

Figure 1:
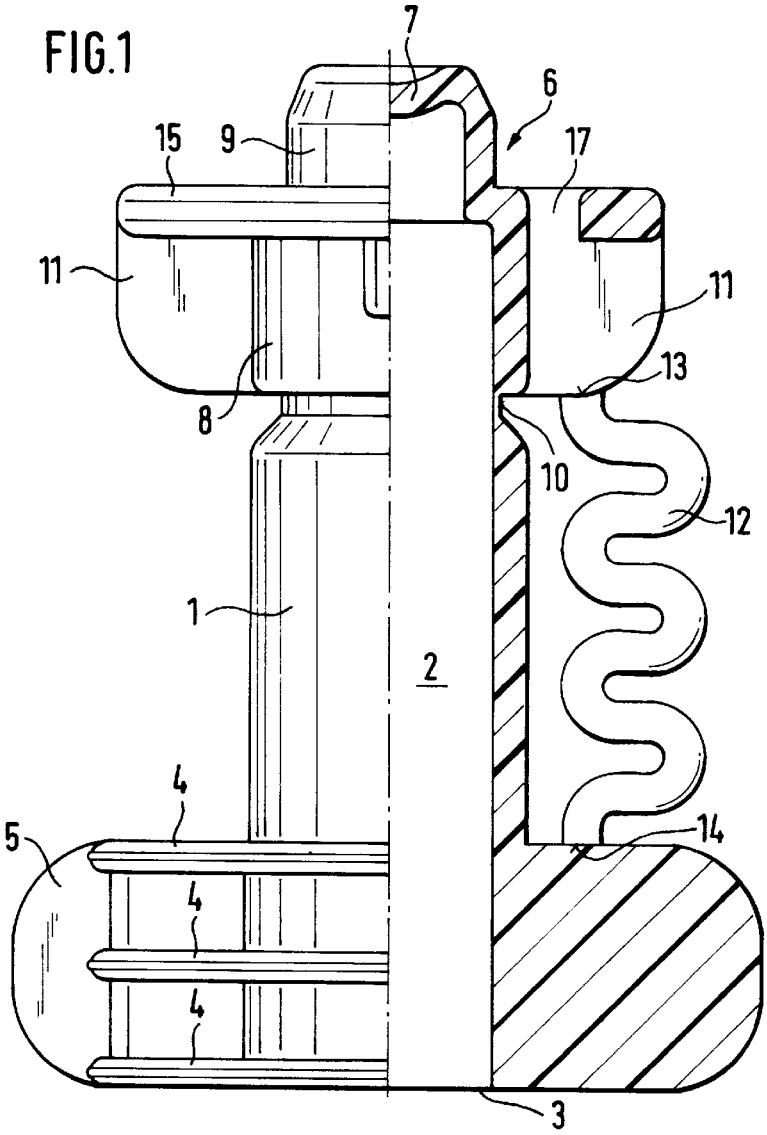
FIG. 1 shows a weld pourer component in accordance with a preferred embodiment of the invention in the form of a partially sectional view (right hand side of the Figure) and an overall view (left hand side of the Figure)
Figure 2:
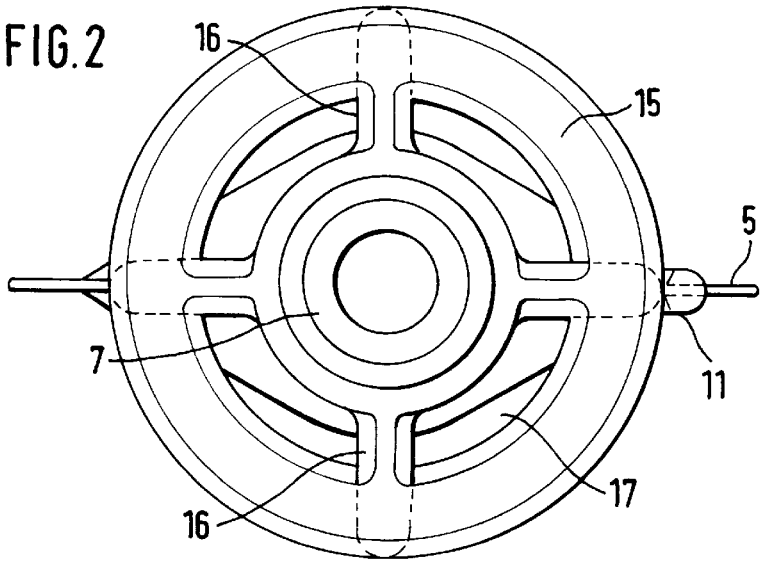
FIG. 2 shows the weld pourer component of FIG. 1 from a top view.

As is illustrated in the drawing, the weld pourer component in accordance with the invention includes a tubular body portion 1 defining a through passage 2 which is open at one axial end 3, this being the lower one in the drawing. By contrast, the opposite, other or upper axial end of the through passage 2 is hermetically sealed by a cap member 6.

Together, the body portion 1 and the cap member 6 form a one-piece moulding of an appropriate synthetic material, preferably, polypropylene (PP) or high density polyethylene (HDPE).

A plurality of axially spaced welding ribs 4 (three welding ribs in the present example) are formed integrally on a peripheral portion of the body portion 1 near the open axial end 3. The welding ribs 4 may be constructed in a manner as described in more detail in WO96/38349 to which reference may therefore be made. A partition 5 traversing centrally through the welding ribs 4 and projecting radially outwardly from diametrically opposite sides of the body portion 1 may be provided for strengthening the welding ribs 4 and for maintaining their relative spacing.

The cap member 6 is formed integrally over a circumferentially extending weakened portion 10 with the body portion 1 near the upper axial end of the through passage 2. The dimensions of the weakened portion 10 are such that it can break under a rotational force exerted manually on the cap member 6 by a user whereby the cap member 6 will be separated from the body portion 1 and the through passage 2 will be opened.

The cap member 6 includes a base wall 7 and a tubular peripheral wall 8 extending axially therefrom in a direction relative to the body portion 1. The cap member 6 thus has an essentially U-shaped or bowl-shaped cross-sectional configuration. The attachment of the cap member 6 to the body portion 1 through the weakened portion 10 is effected near the free end of the peripheral wall 8.

A portion 9 of the peripheral wall 8 near the base wall 7 may have an external dimension matched to the internal dimension of the through passage 2. The peripheral portion 9 can thus be inserted into the through passage 2 so as to seal it when the cap member 6 has been separated from the body portion 1.

In order to facilitate a separation of the cap member 6 from the body portion 1, radially outwardly projecting, wing-like leaves 11 may be provided on the cap member 6 at diametrically opposite positions thereof so that a person can place his fingers thereon in order to apply a rotational force to the cap member 6.

A thin, flexible strap 12 is provided as an integral part of the weld pourer component for permanently connecting the cap member 6 to the body portion 1. As indicated at 14, the strap 12 is formed integrally at one end with one of the welding ribs 4 and, at the other end, as indicated at 13, it is formed integrally with one of the wing-like leaves 11 of the cap member 6, and it extends externally along the body portion 1 not in a straight line, but preferably, in the form of a meander or undulation. By this way, the strap 12 can be extended to a length that is substantially greater than the axial spacing between the connecting portions 13 and 14. The strap 12 thus allows the cap member 6 to be moved away from the body portion 1 when the weakened portion 10 has been broken.

Moreover, as can be seen from the drawing, due to its meandering or undulating form, the strap 12 gives the weld pourer component a particularly aesthetic and distinctive appearance.

It is self evident that the connecting portions 13 and 14 for the strap 12 could be provided at other axially spaced positions of the body portion 1 and the cap member 6 so long as they have a suitable axial spacing. The strap 12 may have any cross-sectional configuration for example a circular or a flat rectangular configuration.

Furthermore, as illustrated, a ring element 15 is integrally formed on the cap member 6 by means of rigid radial webs 16 (four peripherally uniformly spaced webs are provided in the present example) so that an open space or a flow passage 17 is formed between the exterior of the peripheral wall 8 and the inner periphery of the ring element 15 whereby air can flow through said space from a point above the ring element 15 to one below it. The outer dimensions of the ring element 15 should be selected such that they substantially correspond to the maximum outer dimensions of the cap member 6 or such that they are somewhat greater. Preferably, the outer dimensions of the ring element 15 correspond to those of the leaves 11. Furthermore, the ring element 15 should have a rounded section or one having rounded edges so as to prevent injuries to the wind pipe if it has been swallowed. If desired, the ring element 15 could have a sleeve-like construction.

Although the invention has been described hereinabove on the basis of a special embodiment, it is self-evident that it is not restricted thereto. On the contrary, alterations and modifications may be made by a skilled person within the framework of the above teachings without thereby departing from the spirit and essence of the invention.

What is claimed is:

1. A plastic weld pourer component having safety properties for attachment by welding to a container component of plastics material, including a tubular body portion defining a through passage having axially spaced ends, said through passage being open at one of the axial ends, at least one welding rib formed on the outer periphery of the body portion near the open axial end of the through passage and outwardly projecting therefrom, a cap member formed with the body portion near the other axial end of the through passage and having a base wall and a peripheral wall projecting therefrom, said cap member seals the adjacent end of the through passage in that the cap member is attached to the body portion through a circumferentially extending weakened portion adapted to break when a rotational force is exerted by hand on the cap member, and the dimensions of the peripheral wall of the cap member are adapted to those of the body portion such that the cap member can be used for repeatedly sealing the through passage after the cap member has been separated from the body portion, and wherein a ring element peripherally surrounds the cap member in spaced relationship thereto and is attached thereto by means of webs so that an essentially axial breathing passage is formed between the ring element and the exterior of the cap member should the cap member become lodged in a windpipe.

2. A plastics weld pourer component having safety properties in accordance with claim 1, wherein the cap member is permanently connected in one-piece manner to the body portion through a strap extending therebetween.

3. A plastics weld pourer component having safety properties in accordance with claim 2, wherein the strap extends externally of the body portion between a connecting portion on the cap member and a connecting portion axially spaced therefrom on the body portion.

4. A plastics weld pourer component having safety properties in accordance with claim 3, wherein an extended length of the strap is substantially greater than the axial spacing of the connecting portions of the strap.

5. A plastics weld pourer component having safety properties in accordance with claim 4, wherein the strap has a substantially meandering form between the connecting portions.

6. A plastics weld pourer component having safety properties in accordance with claim 1, wherein a portion of the peripheral wall of the cap member near the cap member's base wall is in the form of a sealing cone for sealing engagement with the through passage.

* * * * *